US007465182B1

(12) United States Patent
McDonald

(10) Patent No.: US 7,465,182 B1
(45) Date of Patent: Dec. 16, 2008

(54) ELECTRICAL CORD CONNECTOR ASSEMBLY

(76) Inventor: Michael McDonald, 4088 S. First St., Waterford, WI (US) 53185

( * ) Notice: Subject to any disclaimer, the term of this patent is extended or adjusted under 35 U.S.C. 154(b) by 0 days.

(21) Appl. No.: 11/948,593

(22) Filed: Nov. 30, 2007

(51) Int. Cl.
*H01R 13/62* (2006.01)

(52) U.S. Cl. ..... 439/369; 439/456; 439/521

(58) Field of Classification Search ..... 439/366–373, 439/456, 457, 521
See application file for complete search history.

(56) References Cited

U.S. PATENT DOCUMENTS

| | | | | |
|---|---|---|---|---|
| 4,643,505 | A * | 2/1987 | House et al. | 439/369 |
| 4,917,632 | A | 4/1990 | Smith | |
| 5,197,908 | A | 3/1993 | Nelson | |
| 5,240,433 | A | 8/1993 | Kato | |
| 5,387,119 | A | 2/1995 | Wood | |
| 5,505,634 | A | 4/1996 | Osten | |
| 5,540,450 | A | 7/1996 | Hayashi et al. | |
| 5,772,462 | A | 6/1998 | Osten | |
| 5,863,221 | A | 1/1999 | Castaldo | |
| 5,913,692 | A * | 6/1999 | Targett | 439/369 |
| 5,980,278 | A | 11/1999 | Winkler | |
| 6,007,362 | A | 12/1999 | Davis et al. | |
| 6,059,594 | A | 5/2000 | Davis et al. | |
| 6,099,340 | A * | 8/2000 | Florentine | 439/367 |
| 6,113,429 | A | 9/2000 | Welgel et al. | |
| 6,241,553 | B1 | 6/2001 | Hsia | |
| 6,254,431 | B1 | 7/2001 | Murakami et al. | |
| 6,287,136 | B1 | 9/2001 | Deutsch | |
| 6,464,523 | B1 | 10/2002 | LeVine | |
| 6,478,619 | B1 | 11/2002 | Wiechmann | |
| 6,494,731 | B1 | 12/2002 | Suzuki | |
| 6,602,087 | B1 * | 8/2003 | Carle | 439/369 |
| 6,607,403 | B2 | 8/2003 | Tschope et al. | |
| 6,685,491 | B2 | 2/2004 | Gergek | |
| 7,033,193 | B2 | 4/2006 | Higgins et al. | |
| 7,195,505 | B1 | 3/2007 | Becker | |
| 7,270,556 | B2 | 9/2007 | Mori et al. | |
| 7,384,297 | B2 * | 6/2008 | King et al. | 439/369 |
| 2006/0166554 | A1 | 7/2006 | Hung | |
| 2006/0172580 | A1 | 8/2006 | Scholler et al. | |

* cited by examiner

*Primary Examiner*—James Harvey
(74) *Attorney, Agent, or Firm*—Absolute Technology Law Group, LLC

(57) ABSTRACT

An electrical cord connector assembly for non-permanently holding together a male electrical plug connected to a first electrical cord and a female electrical plug connected to a second electrical cord comprised of: a first portion formed by two halves joined by a first seam, having a first inner surface, and forming a first opening adapted to receive the first electrical cord; a first plurality of walls on the first inner surface and forming a first longitudinal channel; at least one first groove formed between each of first plurality of walls; at least one first locking key sized to fit within one of the first grooves; a second portion formed by two halves joined by a second seam, having a second inner surface, and forming a second opening adapted to receive the second electrical cord; a second plurality of walls on the second inner surface and forming a second longitudinal channel; at least one second groove formed between the second plurality of walls; at least one second locking key sized to fit within one of the second grooves; and a securing mechanism to non-permanently secure the first portion to the second portion.

19 Claims, 8 Drawing Sheets

ELECTRICAL CORD CONNECTOR ASSEMBLY

FIELD OF INVENTION

This invention relates generally to the field of electric cords, and specifically to a coupling assembly that is used to create a tight fit between the mating ends of electrical cords.

BACKGROUND

The male and female ends of mating electrical cords are typically held together by a friction fit. Such a connection is relatively loose and can be pulled apart if the cords are pulled away from another.

In the work place or on the job site, workers often tie the two electrical cord ends together as an additional means of securing the male electrical plug to the female electrical plug to help ensure that the two electrical plugs do not unintentionally disengage when the electrical cords are moved between work spaces or up a ladder. However, the electrical cords must be untied when the electrical cords are to be separated and such a bulky knot can catch on corners or on ladder rungs, resulting in damaging equipment or injuring the worker. The user thus must choose between an electrical cord that can easily be disengaged or is easily snagged when moved.

The present invention provides an apparatus for tightly and temporarily securing the ends of mating electrical cords to each other without creating a bulky and unsafe connection point and is particularly well suited for use with electrical cords having permanently attached male or female plugs.

DETAILED DESCRIPTION OF EMBODIMENTS OF THE INVENTION

For the purpose of promoting an understanding of the present invention, references are made in the text hereof to embodiments of an electrical cord connector assembly, only some of which are described herein. It should nevertheless be understood that no limitations on the scope of the invention are thereby intended. One of ordinary skill in the art will readily appreciate that modifications such as the dimensions, size, and shape of the components, alternate but functionally similar materials from which the components are made, and the inclusion of additional elements are deemed readily apparent and obvious to one of ordinary skill in the art, and all equivalent relationships to those described in the written description do not depart from the spirit and scope of the present invention. Some of these possible modifications are mentioned in the following description. Therefore, specific details disclosed herein are not to be interpreted as limiting but rather as a basis for the claims and as a representative basis for teaching one of ordinary skill in the art to employ the present invention in virtually any appropriately detailed apparatus or manner.

Moreover, the term "substantially" or "approximately" as used herein may be applied to modify any quantitative representation that could permissibly vary without resulting in a change in the basic function to which it is related. For example, one embodiment of the electrical cord connector assembly is disclosed herein as being approximately nine inches (9") long and approximately two and one quarter inches (2¼") wide when closed. The dimensions may be less than or greater than these values and still be within the scope of the invention if its functionality is not materially altered.

Figure 1:
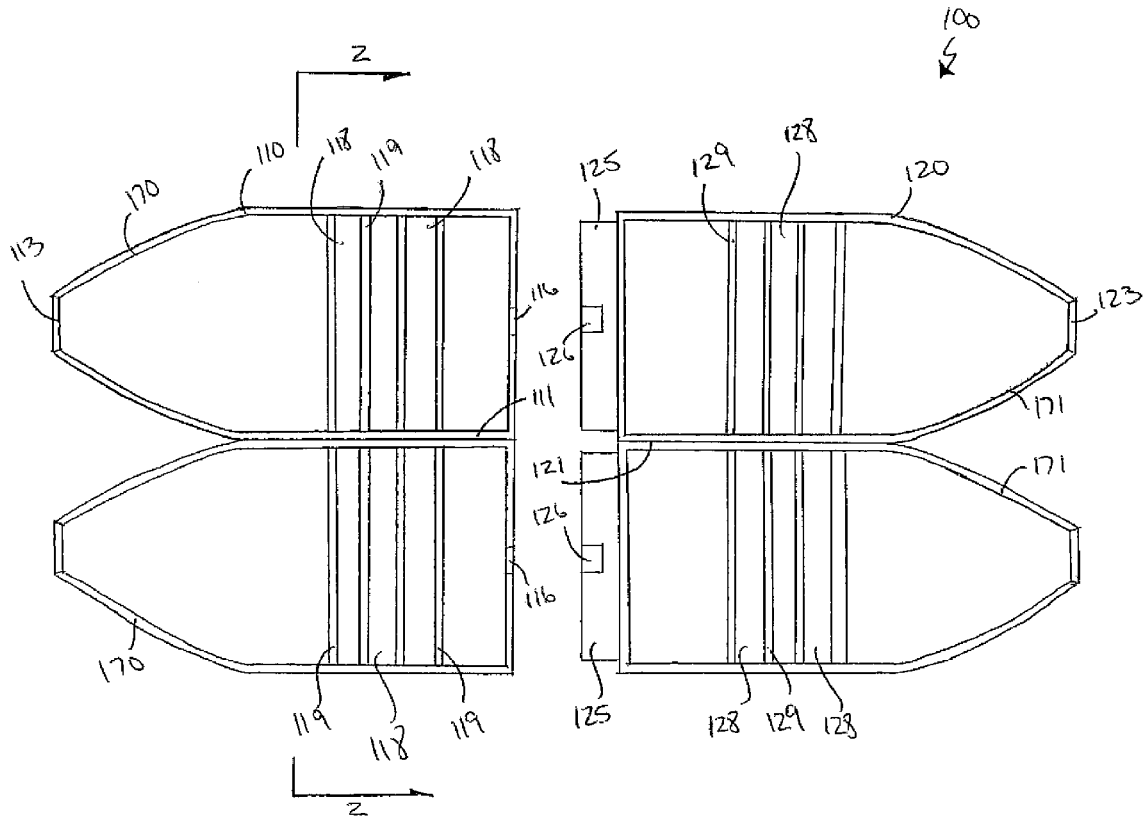
FIG. 1 shows a top view of one embodiment of the electrical cord connector assembly in an open position.

FIG. 1 shows a top view of one (1) embodiment of electrical cord connector assembly 100 in an open position. Electrical cord connector assembly 100 comprises first portion 110 and second portion 120. Each portion 110, 120 includes two (2) halves that mate at seams 111, 121, which allows each half to fold on itself and form a substantially hollow sheath. It should be understood that although each portion 110, 120 is referred to herein as having two (2) halves that can fold on to form a substantially hollow and cylindrically-shaped sheath, each half need not be exactly half of the shape. That is, the two (2) parts that make up first portion 110 and the two (2) parts that make up second portion 120 need not be equally dimensioned.

Also visible in FIG. 1 is tongue 125, which is on second portion 120. Once second portion 120 is folded into a substantially hollow sheath, tongue 125 has an outer diameter approximately the same as the inner diameter of first portion 110 when closed. Thus, first portion 110 and second portion 120 can mate, with tongue 125 frictionally engaging first portion 110. In the embodiment shown, tongue 125 includes two (2) halves that, when second portion 120 is folded on itself, forms a single tongue 125. It should be understood that in alternate embodiments, tongue 125 can be a single element extending from second portion 120 or that tongue 125 (whether a single element or multiple components) can alternately be positioned on first portion 110.

In addition, positioned on tongue 125 is tab 126, and first portion 110 of electrical cord connector assembly 100 further includes recess 116. Once second portion 120 of electrical cord connector assembly 100 is mated with first portion 110 and tongue 125 is inserted within first portion 110 to create the frictional engagement, tab 126 engages recess 116 to further secure first portion 110 to second portion 120, thus creating a snug fit between first portion 110 and second portion 120. In the embodiment shown, there is a single tab 126 and corresponding recess 116. However, it should be understood that multiple tabs 126 and recesses 116 can be used to create the snug fit between first portion 110 and second portion 120 of electrical cord connector assembly 100. It should further be understood, however, that the embodiment of the securing mechanism for non-permanently securing first portion 110 to second portion 120 of electrical cord connector assembly 100 is only one (1) mechanism, i.e., the frictional engagement of tongue 125 and the use of tab 125 and corresponding recess 116, is only one (1) embodiment of a securing mechanism. Other types of temporary securing mechanisms include only the use of tongue 125 for the frictional engagement, other temporary securing mechanisms commonly known and used in the art, and combinations of multiple engagement mechanisms.

Also visible in the embodiment of electrical cord connector assembly 100 shown in FIG. 1 are openings 113, 123. When first portion 110 of electrical cord connector assembly 100 is folded along seam 111, the two (2) halves form opening 113. Similarly, when second portion 120 of electrical cord connector assembly 110 is folded along seam 121, opening 123 is formed. As will be discussed in greater detail infra, when an electrical cord (not shown), having either a male or female electrical plug (not shown), is positioned within first portion 110 and second portion 120, the cord portion extends through openings 113, 123.

Also visible in the embodiment of electrical cord connector assembly 100 shown in FIG. 1 are grooves 118, 128. Referring to first portion 110, in the embodiment shown, first portion 110 includes three (3) grooves 118, with the three (3) grooves 118 being formed by four (4) walls 119, i.e., groove 118 is the space between each wall 119. Similarly, three (3) grooves 128 are formed by four (4) walls 129 on second portion of electrical cord connector assembly 100. As will be discussed in greater detail infra, when first portion 110 is folded on itself along seam 111, each groove 118 forms a substantially circular slot in which a locking clip (not shown; discussed in detail infra) can be positioned to lock the electrical cord within electrical cord connector assembly 100.

Figure 2B:
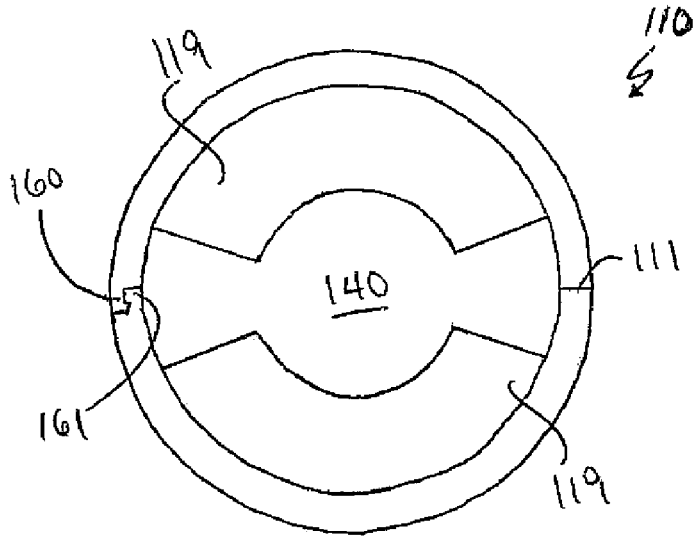
FIG. 2*b* shows a cross-sectional view of the embodiment of the electrical cord connector assembly shown in FIG. 1 taken, along line 2-2, but in the closed position.
Figure 2A:
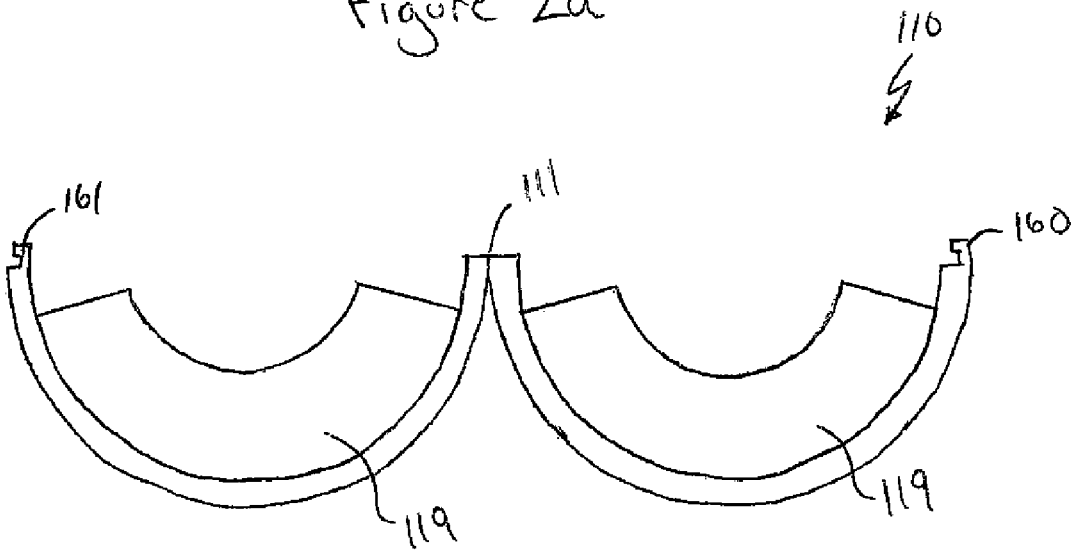
FIG. 2*a* shows a cross-sectional view of the embodiment of the electrical cord connector assembly shown in FIG. 1 taken, along line 2-2.

FIG. 2*a* shows a cross-sectional view of the embodiment of electrical cord connector assembly 100 shown in FIG. 1, taken along line 2-2 in which the shape and position of one (1) wall 119 can be appreciated. Although FIG. 2*a* is a cross-sectional view of only first portion 110 of electrical cord connector assembly 100, as provided supra, first portion 110 has multiple walls 119.

FIG. 2*b* shows a cross-sectional view of the embodiment of electrical cord connector assembly 100 shown in FIG. 1 taken, along line 2-2, but in the closed position. As can be seen, in the embodiment shown, a portion of wall 119 is on each side of first portion 110 and has a generally rounded shape. The rounded shape forms channel 140 running substantially the length of electrical cord connector assembly 100. The electrical cord (not shown), whether connected to a male electrical plug or a female electrical plug (not shown), fits within channel 140, and channel 140 and walls 119 are sized to fit around the electrical cord.

Referring to FIGS. 2*a* and 2*b* collectively as provided supra, both first portion 110 and second portion 120 comprise two (2) halves that fold along seam (not visible) to form a substantially hollow tube. Each half if temporarily locked to the other half by tabs 160, 161 which mate to temporarily secure the halves to each other. One of ordinary skill in the art will recognize that alternate mechanisms can be employed to close both first portion 110 and second portion 120, that multiple closing mechanisms can be used, and that the same closing mechanism need not be used for both closing mechanisms.

Figure 3A:
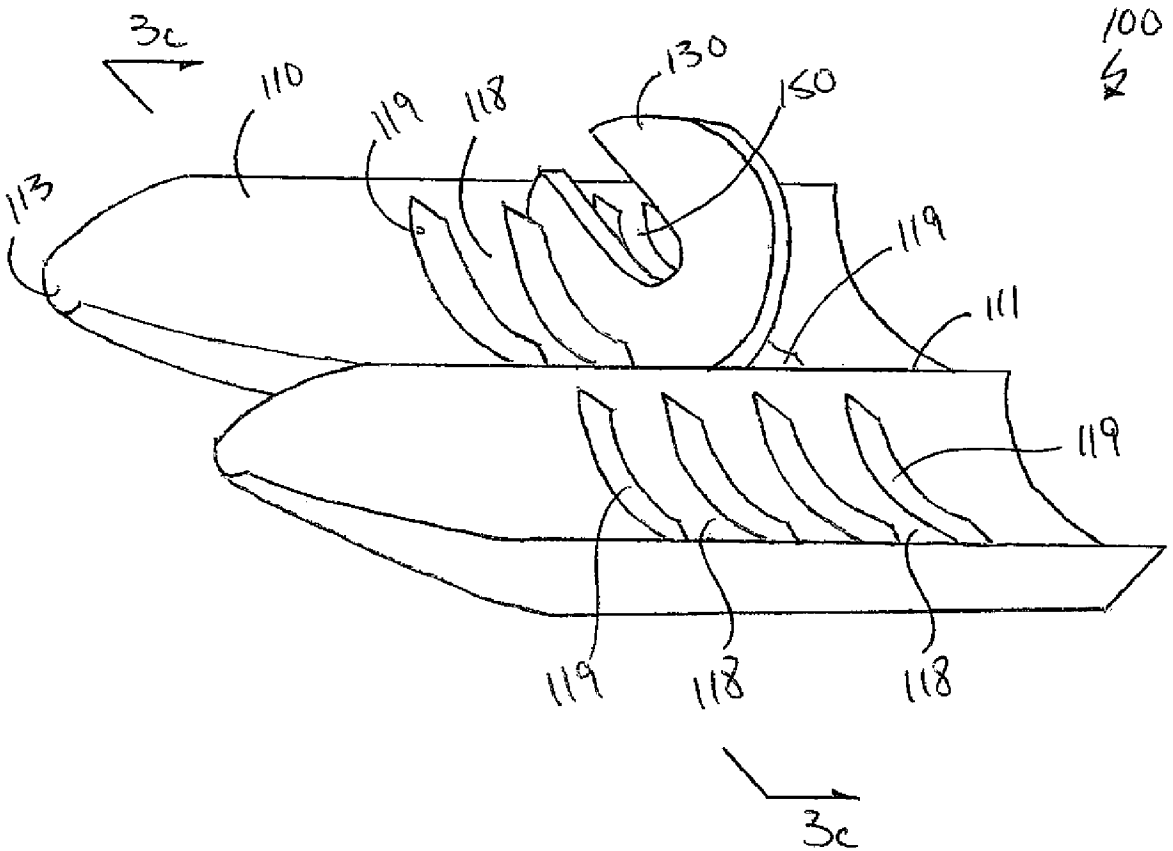
FIG. 3*a* shows a side perspective view of the embodiment of the first portion of the electrical cord connector assembly shown in FIG. 1 in an open position, further including two locking keys.

FIG. 3*a* shows a side perspective view of the embodiment of first portion, 110 of electrical cord connector assembly 100 shown in FIG. 1 in an open position, further including one (1) locking key 130. Locking key 130 fits within one (1) groove 118, formed by walls 119 in first portion 110 of electrical cord connector assembly 100. It should be understood that a similar mechanism as shown and described is used in the second portion (not shown) of electrical cord connector assembly 100. As will be explained in greater detail infra, locking key 130 maintains the male electrical plug (or the female electrical plug) of an electrical cord (not shown) within first portion 110. In the embodiment shown, locking key 130 is one eighth of an inch (⅛") thick and is made of plastic, and each groove 118 is slightly greater than one eighth of an inch (⅛") wide to accommodate locking key 130.

Figure 3B:
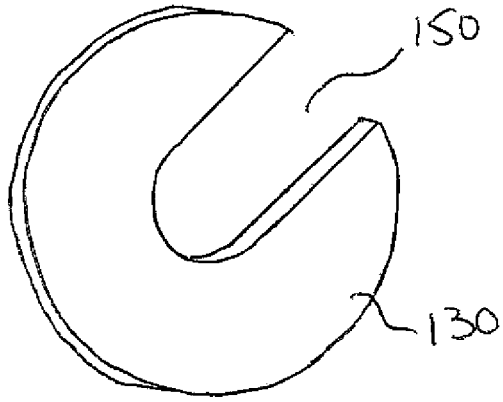
FIG. 3*b* shows a front view of one (1) embodiment of a locking key.

FIG. 3*b* shows a front view of one (1) embodiment of locking key 130. Referring to FIGS. 3*a* and 3*b*, locking key 130 has a diameter slightly less than the inner diameter of first portion 110, so that it fits within first portion 110 when first portion 110 is closed, and a thickness slightly less than the thickness of groove 118, so that it fits within groove 118 without excessive movement. Also visible is opening 150. Opening 150 allows the electrical cord (not shown) to be positioned through the center of locking key 130. However, opening 150 is small enough such that the electrical plug (whether male or female; not shown) connected to the electrical cord not to pass through opening 150.

Figure 3C:
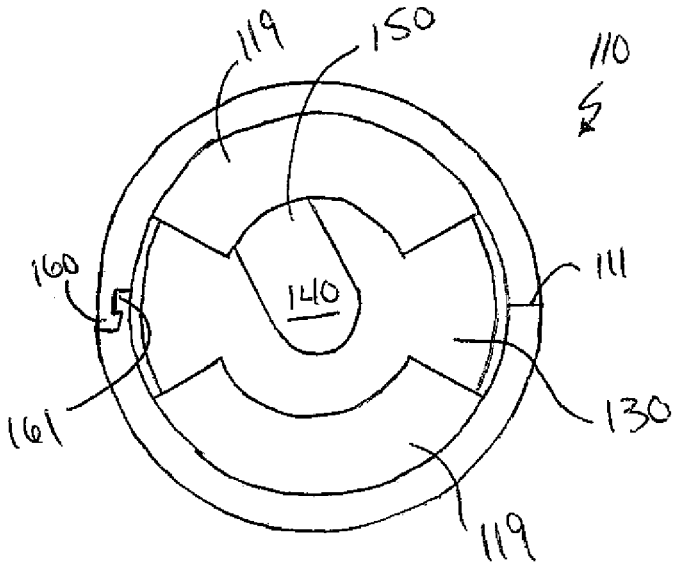
FIG. 3*c* shows a cross-sectional view of the embodiment of the electrical cord connector assembly shown in FIG. 3*a* taken, along line 3*c*-3*c*, but in the closed position.

FIG. 3*c* shows a cross-sectional view of the embodiment of first portion 110 of electrical cord connector assembly 100 shown in FIG. 3*a*, taken, along line 3*c*-3*c*, but in the closed position. As can be seen, when first portion 110 of electrical cord connector assembly 100 is closed and locking key 130 is positioned therein and maintained in place by walls 119, opening 150 of locking key 130 aligns with channel 140 formed along the center axis of first portion 130 (through which the electrical cord runs when placed within first portion 130).

Figure 4A:
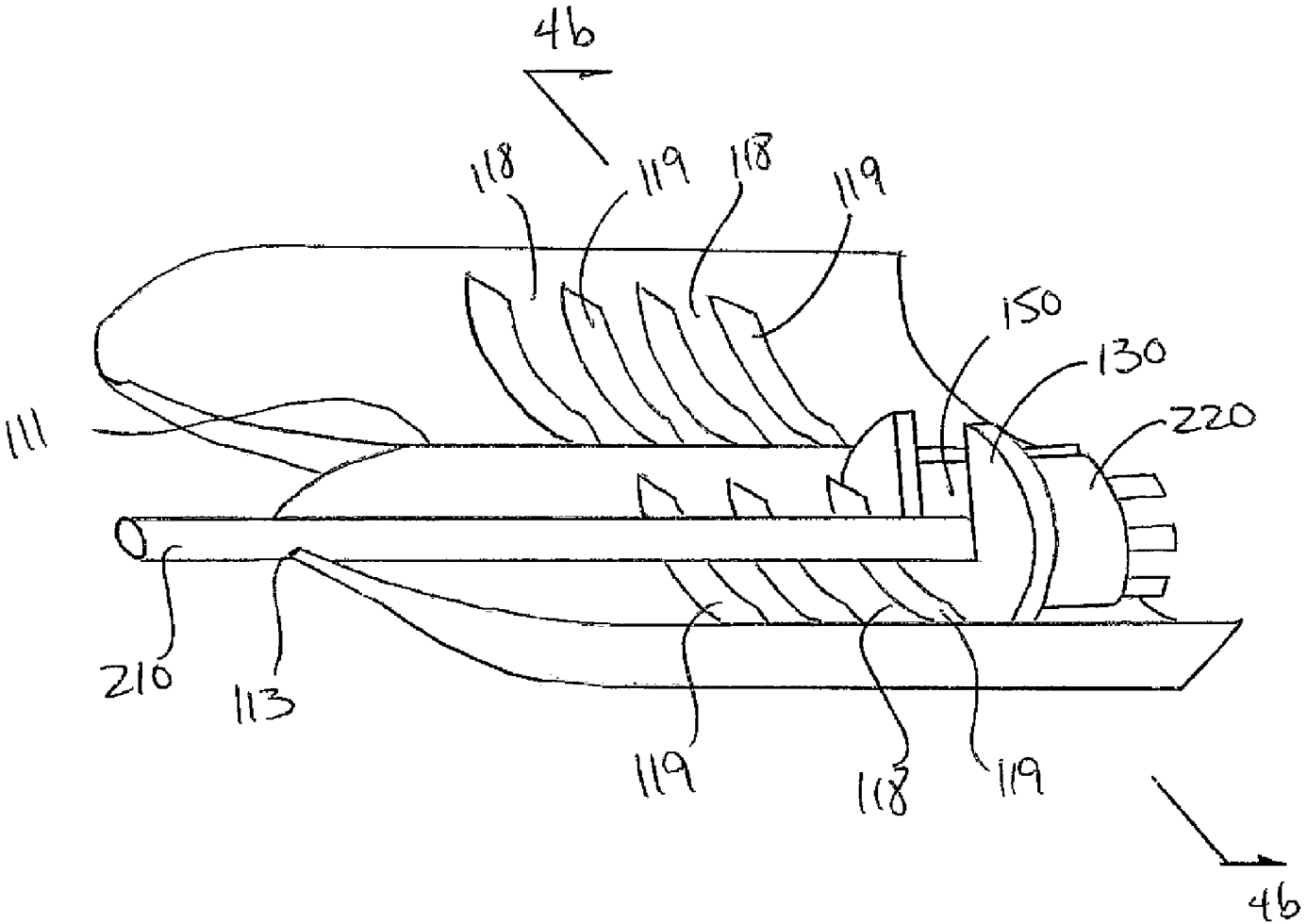
FIG. 4*a* shows a side perspective view of the embodiment of the first portion of the electrical cord connector assembly shown in FIG. 1 in an open position, further including mating ends of two electrical cords and the locking keys.

FIG. 4*a* shows a side perspective view of first portion 110 of the embodiment of electrical cord connector assembly 100 shown in FIG. 1 in an open position, further including male electrical plug 220 of electrical cord 210, and including locking key 130. Locking key 130 is positioned within groove 118, and electrical cord 210 is positioned within opening 150 of locking key 130. When first portion 110 is closed, i.e., the two (2) halves are joined to form a substantially hollow structure, locking key 130 is secured within groove 118 and male electrical plug 220 of electrical cord 210 is locked in position such that electrical cord 210 cannot be pulled rearward (leftward from the perspective shown). Although not shown, a female electrical plug (not shown) attached to a second electrical cord (not shown) would be positioned within a second portion (not shown) and locked therein by a second locking key (not shown). It should be noted, too, that the female electrical plug could be positioned in first portion 110 and male electrical plug 220 be positioned in the second portion of electrical cord connector assembly 100.

Figure 4B:
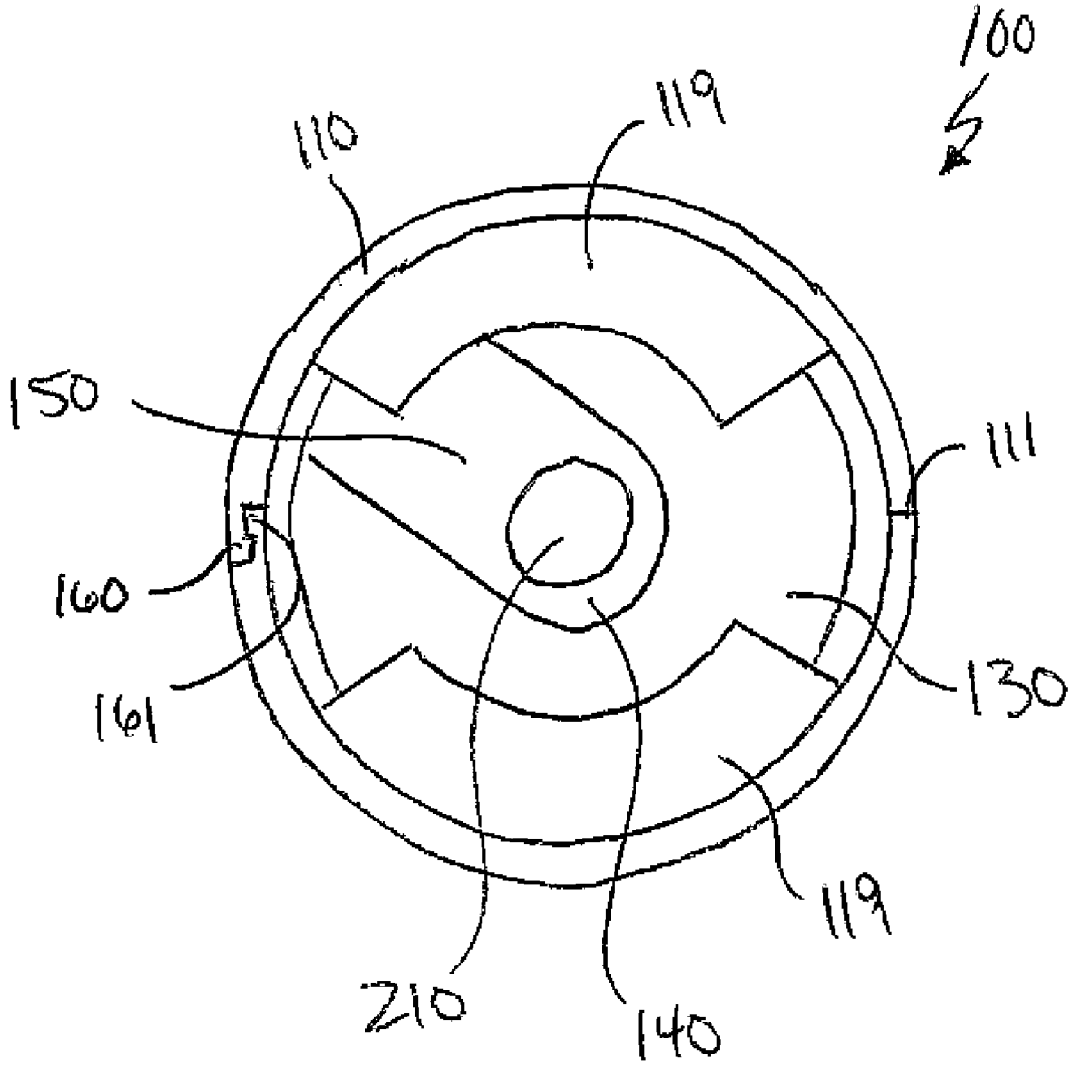
FIG. 4*b* shows a cross-sectional view of the embodiment of the first portion of the electrical cord connector assembly shown in FIG. 4*a* taken, along line 4*a*-4*a*, but in the closed position.

FIG. 4*b* shows a cross-sectional view of the embodiment of first portion 110 of electrical cord connector assembly 100 shown in FIG. 4*a* taken, along line 4*a*-4*a*, but in the closed position. As can be seen, when closed male electrical plug 220 is snugly positioned within first portion 110 of electrical cord connector assembly 100, with electrical cord 210 positioned within opening 150 of locking key 130 and substantially along the length of channel 140 formed by walls 119.

Figure 5:
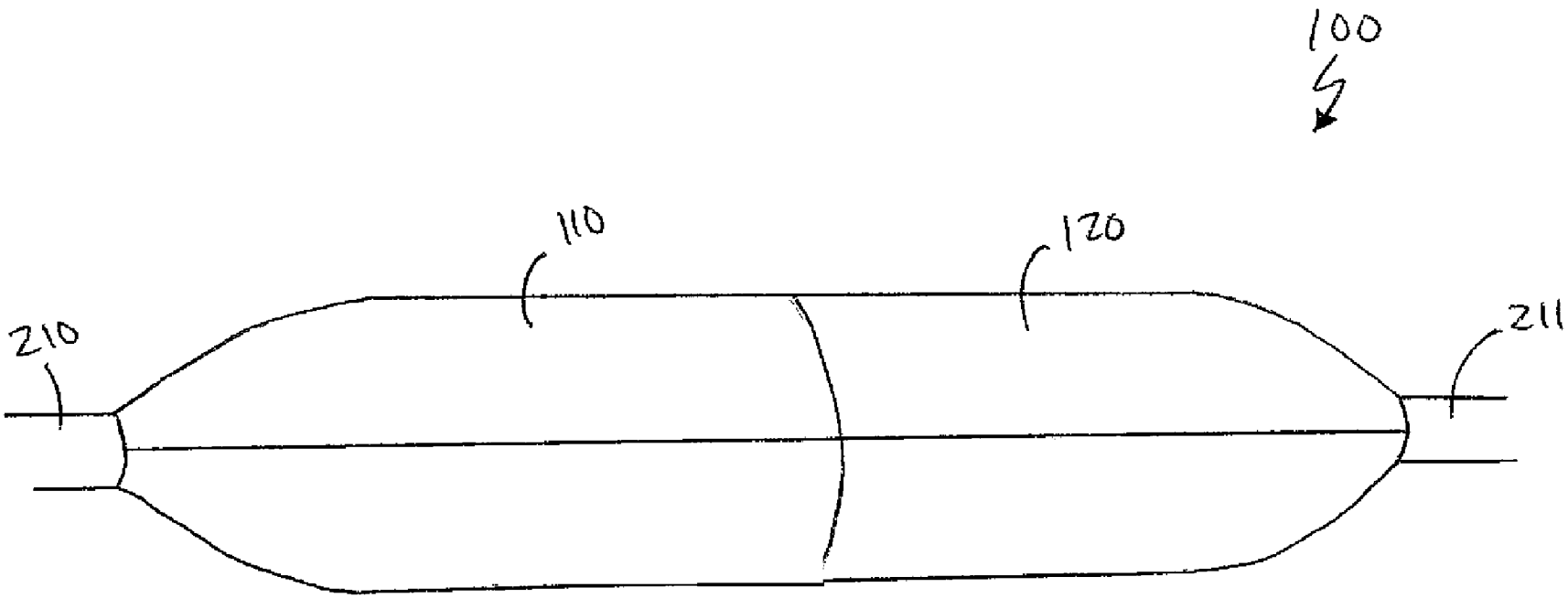
FIG. 5 shows a side perspective view of the electrical cord connector assembly shown in FIG. 1 in a closed position.

FIG. 5 shows a side perspective view of electrical cord connector assembly 100 shown in FIG. 1 in a closed position. In the embodiment shown, when first portion 110 is connected to second portion 120, electrical cord connector assembly 100 is approximately nine inches (9") long and approximately two and one quarter inches (2¼") wide. Also in the embodiment shown, electrical cord connector assembly 100 is made of composite plastic formed by injection molding, but can be made of any sufficiently durable material commonly known and used in the art.

As can be appreciated, when first portion 110 and second portion 120 are connected, electrical cord connector assembly 100 becomes a low profile means for connecting the male and female electrical plugs (not shown) of electrical cords 210, 211. In addition, if, for example, first portion 110 is positioned on the male end of electrical cord 210 of an electrical device (not shown), the electrical device can be disconnected from second portion 120 of electrical cord connector assembly 100 and re-connected to a different electrical cord 211 positioned within an alternate second portion 120. Similarly, the electrical device, having the male electrical plug positioned within first portion 110 can be disconnected from the female electrical plug of second electrical cord 211 and an alternate electrical device (not shown), having a different first portion 110 of electrical cord connector assembly 100 positioned on the male connector, can instead be connected to second portion 120. Thus, first portion 110 and second portion 120 of electrical cord connector assembly 100 are interchangeable with other first portions 110 and second portions 120. It should also be understood that the two (2) examples, having the male connector of electrical cord 210 positioned within first portion 110 of electrical cord connector assembly 100 and the female connector of electrical cord 211 can be reversed. That is, first portion 110 can be positioned on either the female electrical plug or male electrical plug, and second portion 120 can be positioned on either the male electrical plug or the female electrical plug.

Figure 6:
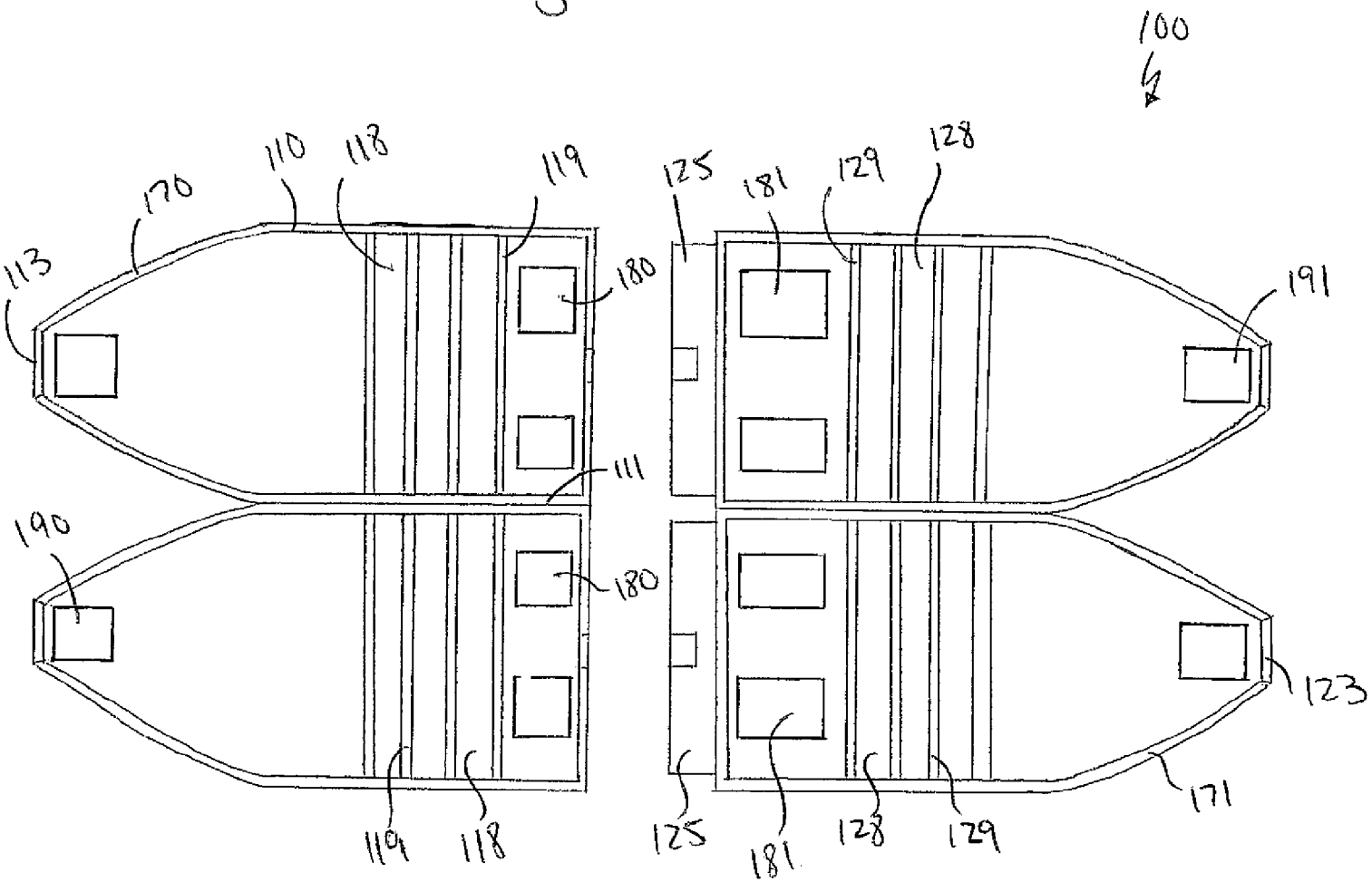
FIG. 6 shows a top view of one alternate embodiment of the electrical cord connector assembly in an open position, further including pads.

FIG. 6 shows a top view of one (1) alternate embodiment of electrical cord connector assembly 100 in an open position, further including pads 180, 181, 190, and 191. Pads 180, 181 are positioned along the inner surface of first portion 110 and second portion 120, respectively, and are to provide a cushion to the male and/or female electrical plugs (not shown). Pads 180, 181 can be made of any material commonly known and used in the art. In the embodiment shown, pads 180, 181 are each made of foam and are between one and one quarter inches (1¼") and one and one half inches (1½") long and one half inch (½") thick.

In addition, pads 190, 191 are shown positioned at openings 113, 123 of first portion 110 and second portions 120, respectively. Pads 190, 191 provide a water-tight seal between electrical cords (not shown) and first portion 110 and second portion 120. FIG. 1 shows an embodiment of electrical cord connector assembly 100 without any pads, and FIG. 6 shows an embodiment of electrical cord connector assembly 100 with cushioning pads 180, 181 and water-tight pads 190, 191. However, in alternate embodiments, electrical cord connector assembly 100 can have just cushioning pads 180, 181, or just water-tight pads 190, 191. In addition, any number of pads 180, 181, 190, 191 can be employed in the various embodiments of electrical cord connector assembly 100.

Also visible in FIG. 6 is that the distal ends 170, 171 of first portion 110 and second portion 120 are tapered, i.e., have a lesser diameter than the bulk of electrical cord connector assembly 100. The tapering provides a lower profile at distal ends 170, 171 such that when the electrical cord (not shown), joined by electrical cord connector assembly 100, is moved, there is a decreased risk of electrical cord connector assembly 100 catching or snagging another object, thereby risking injury to the user or damage to the electrical device (not shown). In the embodiment shown, distal ends 170, 171 are tapered, but can also be rounded. In addition, it should be understood that alternate embodiments of electrical cord connector assembly 100 do not include tapered or rounded distal ends 170, 171.

While the electrical cord connector assembly has been shown and described with respect to several embodiments in accordance with the present invention, it is to be understood that the same is not limited thereto, but is susceptible to numerous changes and modifications as known to a person of ordinary skill in the art, and it is intended that the present invention not be limited to the details shown and described herein, but rather cover all such changes and modifications obvious to one of ordinary skill in the art.

What is claimed is:

1. An electrical cord connector assembly comprised of:

a first portion, said first portion formed by two halves joined by a first seam and having a first inner surface;

a first plurality of walls positioned on said first inner surface and forming a first longitudinal channel therethrough;

at least one first groove formed between each of said first plurality of walls;

at least one first locking key, said at least one first locking key sized to fit within one of said at least one first groove;

a second portion, said second portion formed by two halves joined by a second seam and having a second inner surface;

a second plurality of walls positioned on said second inner surface and forming a second longitudinal channel therethrough;

at least one second groove formed between each of said second plurality of walls;

at least one second locking key, said at least one second locking key sized to fit within one of said at least one second groove;

a securing mechanism for non-permanently mating said first portion with said second portion; and wherein said electrical cord connector assembly is adapted to non-permanently hold together a male electrical plug connected to a first electrical cord and a female electrical plug connected to a second electrical cord.

2. The electrical cord connector assembly of claim 1, wherein said electrical cord connector assembly is made of a composite plastic formed by injection molding.

3. The electrical cord connector assembly of claim 1, wherein said electrical cord connector assembly further includes at least one first pad positioned on said first inner surface of said first portion and at least one second pad positioned on said second inner surface of said second portion, said at least one first pad and said at least one second pad adapted to cushion said male electrical plug or said female electrical plug.

4. The electrical cord connector assembly of claim 1, wherein said electrical cord connector assembly further includes at least one first pad positioned on said first inner surface of said first portion and at least one second pad positioned on said second inner surface of said second portion, said at least one first pad and said at least one second pad adapted to provide a water-tight seal.

5. The electrical cord connector assembly of claim 1, wherein said securing mechanism comprises a tongue positioned on said second portion and adapted to frictionally engage said first portion.

6. The electrical cord connector assembly of claim 5, wherein said securing mechanism further comprises a first tab on said tongue and a corresponding recess on said first portion to temporarily secure said second portion to said first portion.

7. The electrical cord connector assembly of claim 1, wherein said two halves of said first portion can be temporarily secured to each other by a first clip and a corresponding first tab, and wherein said two halves of said second portion can be temporarily secured to each other by a second clip and a corresponding second tab.

8. An electrical cord connector assembly for non-permanently holding together a male electrical plug connected to a first electrical cord and a female electrical plug connected to a second electrical cord comprised of:

a first portion, said first portion formed by two halves joined by a first seam, having a first inner surface, and forming a first opening adapted to receive said first electrical cord;

at least one first pad positioned on said first inner surface;

a first plurality of walls positioned on said first inner surface and forming a first longitudinal channel therethrough;

at least one first groove formed between each of said first plurality of walls;

at least one first locking key, said at least one first locking key sized to fit within one of said at least one first groove;

a second portion, said second portion formed by two halves joined by a second seam, having a second inner surface, and forming a second opening adapted to receive said second electrical cord;

at least one second pad positioned on said second inner surface;

a second plurality of walls positioned on said second inner surface and forming a second longitudinal channel therethrough;

at least one second groove formed between each of said second plurality of walls;

at least one second locking key, said at least one second locking key sized to fit within one of said at least one second groove; and a securing mechanism for non-permanently mating said first portion with said second portion.

9. The assembly of claim 8, wherein said electrical cord connector assembly is made of a composite plastic formed by injection molding.

10. The assembly of claim 8, wherein said securing mechanism comprises a tongue positioned on said second portion and adapted to frictionally engage said first portion.

11. The assembly of claim 10, wherein said securing mechanism further comprises a first tab on said tongue and a corresponding recess on said first portion to temporarily secure said second portion to said first portion.

12. The assembly of claim 8, wherein said two halves of said first portion can be temporarily secured to each other by a first clip and a corresponding first tab, and wherein said two halves of said second portion can be temporarily secured to each other by a second clip and a corresponding second tab.

13. An electrical cord connector assembly comprised of:

a first portion, said first portion formed by two halves joined by a first seam, having a first inner surface, and forming a first opening adapted to receive a first electrical cord;

a first plurality of walls positioned on said first inner surface and forming a first longitudinal channel therethrough;

at least one first groove formed between each of said first plurality of walls;

at least one first locking key, said at least one first locking key sized to fit within one of said at least one first groove;

a second portion, said second portion formed by two halves joined by a second seam, having a second inner surface, and forming a second opening adapted to receive a second electrical cord;

a second plurality of walls positioned on said second inner surface and forming a second longitudinal channel therethrough;

at least one second groove formed between each of said second plurality of walls;

at least one second locking key, said at least one second locking key sized to fit within one of said at least one second groove;

a securing mechanism for non-permanently mating said first portion with said second portion; and wherein said electrical cord connector assembly is adapted to non-permanently hold together a male electrical plug connected to said first electrical cord and a female electrical plug connected to said second electrical cord.

14. The electrical cord connector assembly of claim 13, wherein said electrical cord connector assembly is made of a composite plastic formed by injection molding.

15. The electrical cord connector assembly of claim 13, wherein said electrical cord connector assembly further includes at least one first pad positioned on said first inner surface of said first portion and at least one second pad positioned on said second inner surface of said second portion, said at least one first pad and said at least one second pad adapted to cushion said male electrical plug or said female electrical plug.

16. The electrical cord connector assembly of claim 13, wherein said electrical cord connector assembly further includes at least one first pad positioned on said first inner surface of said first portion and at least one second pad positioned on said second inner surface of said second portion, said at least one first pad and said at least one second pad adapted to provide a water-tight seal.

17. The electrical cord connector assembly of claim 13, wherein said securing mechanism comprises a tongue positioned on said second portion and adapted to frictionally engage said first portion.

18. The electrical cord connector assembly of claim 17, wherein said securing mechanism further comprises a first tab on said tongue and a corresponding recess on said first portion to temporarily secure said second portion to said first portion.

19. The electrical cord connector assembly of claim 13, wherein said two halves of said first portion can be temporarily secured to each other by a first clip and a corresponding first tab, and wherein said two halves of said second portion can be temporarily secured to each other by a second clip and a corresponding second tab.

* * * * *